US008328320B2

(12) United States Patent
Nakata

(10) Patent No.: US 8,328,320 B2
(45) Date of Patent: Dec. 11, 2012

(54) SHEET TRANSPORT DEVICE, RECORDING APPARATUS INCLUDING THE SAME, AND SHEET TRANSPORT METHOD

(75) Inventor: Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 364 days.

(21) Appl. No.: 12/704,446

(22) Filed: Feb. 11, 2010

(65) Prior Publication Data

US 2010/0245516 A1 Sep. 30, 2010

(30) Foreign Application Priority Data

Mar. 25, 2009 (JP) ..... 2009-074383

(51) Int. Cl.
*B41J 2/01* (2006.01)
*B65H 7/02* (2006.01)

(52) U.S. Cl. ..... 347/16; 347/104; 271/270

(58) Field of Classification Search ..... 347/16, 347/104; 271/270
See application file for complete search history.

(56) References Cited

U.S. PATENT DOCUMENTS

| | | | | |
|---|---|---|---|---|
| 4,803,354 | A | 2/1989 | Onodera et al. | |
| 5,209,589 | A * | 5/1993 | Bliss | 400/568 |
| 6,101,426 | A | 8/2000 | Kimura et al. | |
| 6,827,421 | B2 * | 12/2004 | Nunokawa et al. | 347/19 |
| 7,744,186 | B2 | 6/2010 | Yoshida | |
| 8,215,742 | B2 * | 7/2012 | Nakata | 347/16 |
| 2007/0126837 | A1 * | 6/2007 | Takahashi et al. | 347/104 |
| 2008/0007586 | A1 | 1/2008 | Yoshida | |
| 2008/0073832 | A1 * | 3/2008 | Sudo et al. | 271/258.01 |
| 2010/0045725 | A1 * | 2/2010 | Saito et al. | 347/16 |
| 2010/0220140 | A1 | 9/2010 | Yoshida | |
| 2010/0259577 | A1 * | 10/2010 | Nakata | 347/16 |

FOREIGN PATENT DOCUMENTS

| | | |
|---|---|---|
| CN | 101096156 A | 1/2008 |
| JP | 62-238415 | 10/1987 |
| JP | 07-009715 | 1/1995 |
| JP | 11-049399 | 2/1999 |
| JP | 2002-310613 | 10/2002 |
| JP | 2007-161389 | 6/2007 |
| JP | 2008-145299 | 6/2008 |

* cited by examiner

*Primary Examiner* — Daniel Petkovsek
(74) *Attorney, Agent, or Firm* — Workman Nydegger

(57) ABSTRACT

A sheet transport device includes a transporter that transports a sheet from an upstream side to a downstream side in a transport direction by a transport roller; a driver that drives the transporter; a phase sensor that detects a phase start point and a rotation phase indicating an amount of rotation from the phase start point of the transport roller that is rotated by driving of the driver; a memory that stores correction phases for correcting transport distance of the sheet that is transported by rotation of the transport roller; a corrector that selectively performs correction control using a unit correction amount for the rotation of the transport roller, and controls the performance of the correction control based on the rotation phase of the rotation.

3 Claims, 6 Drawing Sheets

SHEET TRANSPORT DEVICE, RECORDING APPARATUS INCLUDING THE SAME, AND SHEET TRANSPORT METHOD

BACKGROUND

1. Technical Field

The present invention relates to a sheet transport device transporting a sheet from the upstream side to the downstream side in a transport direction, a recording apparatus including the sheet transport device, and a sheet transport method.

2. Related Art

An ink jet printer (hereinafter, "printer") has been widely known as a recording apparatus recording on a sheet transported by a sheet transport device (hereinafter, briefly "transport device"). The transport device in the printer transports the sheet by a predetermined distance at an interval by controlling an amount of rotation of a transport roller based on the output result of a rotary encoder coaxially provided with the transport roller transporting the sheet in the sub scanning direction (transport direction).

The rotary encoder includes a disk shape encoder scale on which graduations are formed. The encoder scale rotates with the transport roller and obtains a phase of the transport roller corresponding to the graduations passing a sensor. Accordingly, if the center of rotation of the encoder scale is deviated from the center of the disk, causing eccentricity, an actual transport distance of the sheet varies periodically and continuously.

In a printer disclosed in JP-A-11-49399, the circumference of an encoder scale is divided into a plurality of sections, and a correction value (number of pulses) for each section is set in advance and stored. When the count of the encoder scale is a predetermined count in the corresponding section, a transport distance of a sheet is corrected by changing the amount of rotation of the transport roller, with the number of pulses corresponding to the correction value being supplied.

In the case of recent printers in which variations of sheet transport distance are reduced by improvement of assembling precision, an amount of deviation for one count of the encoder is very small. Accordingly, the count for one pulse that is the minimum unit of the correction amount becomes large and a highly accurate calculation may be needed. Since the count for the graduation of the encoder scale becomes large and the degree of precision is high, more storage areas may be required. Operation speed may be reduced because of the large count, and if the calculation is not performed precisely, correction may not be performed at a suitable time.

SUMMARY

An advantage of some aspects of the present invention is to provide a sheet transport device in which transport distance of a sheet can be corrected by suppressing a shift in the correction time and reducing control load even though the variation of transport distance of the sheet is small at each phase of the transport roller, to provide a recording apparatus including the sheet transport device, and a sheet transport method.

According to an aspect of the invention, a sheet transport device includes a transporter that transports a sheet from an upstream side to a downstream side in a transport direction by a transport roller, a driver that drives the transporter, a phase sensor that detects a phase start point and a rotated phase indicating an amount of rotation from the phase start point of the transport roller that is rotated by driving the driver, a memory that stores correction phases for correcting a transport distance of the sheet that is transported by rotation of the transport roller, a corrector that selectively performs correction control of a unit correction amount for the rotation of the transport roller, and controls the performance of the correction control based on the rotation phase of the rotation.

According to the configuration, correction phases for correcting an amount of rotation of the transport roller are related to rotation phases of the transport roller and stored, causing the rotation amount of the transport roller to be corrected at appropriate times. In addition, correction times are stored in advance as phases of the transport roller, which reduces the control load. Accordingly, a transport distance of the sheet can be corrected by suppressing a shift in the correction time and reducing control load even though the variation of transport distance of the sheet is small at each phase of the transport roller.

Since the amount of correction performed for the corresponding correction phase is constant, the correction phase can be easily set on the basis of an actual transport distance of the sheet during one rotation of the transport roller. That is, the transport distance continuously varies because of eccentricity or the like of the transport roller, a correction phase can be set in which accumulated differences between an actual transport distance of the sheet and a calculated transport distance from the detected rotation phase becomes the unit correction amount. In addition, the correction amounts for corresponding correction positions of the transport roller need not be stored independently, so that storage areas can be used efficiently.

It is preferable that the unit correction amount is the minimum unit detectable by the phase sensor.

According to this configuration, the correction is performed with the minimum unit detectable by the phase sensor and the variation of transport distance of the sheet is further reduced, so that the sheet can be transported more precisely.

According to another aspect of the invention, a recording apparatus includes the sheet transport device and a recording unit that performs recording with a recording material adhering to the sheet transported by the sheet transport device.

According to this configuration, recording can be performed on the sheet for which the variations of transport distance that occur continuously at a cycle of one rotation of the transport roller are reduced. Accordingly, a shade on a recorded sheet caused by the variations of transport distance is suppressed and a recording quality can be improved.

According to further aspect of the invention, a sheet transport method includes transporting a sheet from an upstream side to a downstream side in a transport direction by rotating a transport roller, detecting a phase start point and a rotation phase indicating a rotation amount from the phase start point of the transport roller in the transportation, correcting the amount of rotation of the transport roller when the rotation phase detected in the detection becomes a correction phase.

According to this configuration, advantages similar to those of the sheet transport device can be obtained.

DESCRIPTION OF EXEMPLARY EMBODIMENTS

Figure 1:
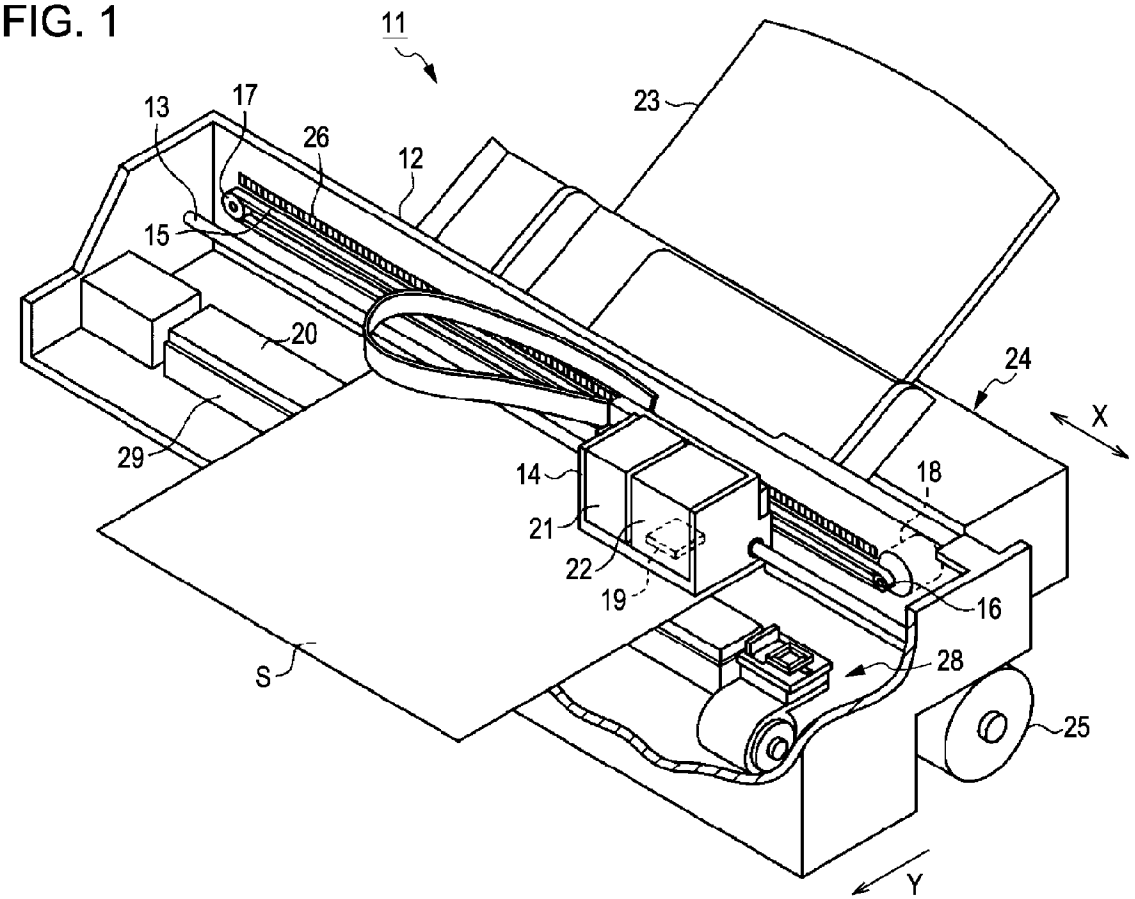
FIG. 1 is a schematic perspective view of a printer according to an embodiment of the invention.

Hereinafter, an embodiment of the invention applied to an ink jet recording apparatus will be described with reference to FIGS. 1 to 7. FIG. 1 is a perspective view of an ink jet recording apparatus in which a cover case is removed. As shown in FIG. 1, the ink jet recording apparatus as a recording apparatus (hereinafter referred to as a printer 11) includes a main body case 12 in the substantially square-box shape in which the upper side is opened and a carriage 14 at a guide shaft 13 arranged in the main body case 12. The carriage 14 is guided to reciprocate in a main scanning direction (X direction in FIG. 1).

The printer 11 further includes a timing belt 15 in a loop shape to which the backside of the carriage 14 is fixed. The timing belt 15 is wound on a pair of pulleys 16, 17 arranged on the inside of a backboard of the main body case 12. The carriage 14 reciprocates in the main scanning direction X by forward and reverse driving of a carriage motor (hereinafter, referred to as a "CR motor 18") a driving shaft of which is connected with the pulley 16.

In a lower side of the carriage 14 is arranged a recording head 19 (recording unit) ejecting ink as a recording material. At a lower position in the main body case 12 facing the recording head 19, a platen 20 which defines a space between the printing head 19 and a sheet S extends in the X direction. On the upper side of the carriage 14, black and color ink cartridges 21, 22 are detachably installed. The recording head 19 ejects ink of each color supplied from the ink cartridges 21, 22 through corresponding nozzles.

On the backside of the printer 11, a sheet feeding tray 23 and an auto sheet feeder 24 are provided. The auto sheet feeder 24 separates and feeds the uppermost sheet in a plurality of sheets S stacked in the sheet feeding tray 23 in a sub scanning direction Y (from the upstream side to the downstream side in the transporting direction).

In addition, the printer 11 includes a sheet feeding motor (hereinafter referred to as a "PF motor 25") installed in a lower right portion of the main body case 12 shown in FIG. 1. A sheet feeding roller 33 (see FIG. 2) of the auto sheet feeder 24 and a transport device 36 (see FIG. 2) as a sheet transport device are driven by driving the PF motor 25, thereby transporting the sheet S in the sub scanning direction Y. The printer 11 substantially alternatively repeats a printing operation and a sheet transporting operation (although, timing of each operation partly overlaps), thereby printing characters, images, and the like on the sheet S. In the printing operation, the recording head 19 ejects ink from the nozzles toward the sheet S while the carriage 14 reciprocates in the main scanning direction X. In the sheet transporting operation, the sheet S is transported by a predetermined transport distance in the sub scanning direction Y.

The printer 11 further includes a linear encoder 26 that is installed extending along the guide shaft 13 and outputs the number of pulses proportional to a moving distance of the carriage 14. Velocity and a position of the carriage 14 are controlled on the basis of a moving position, a moving direction, and a moving velocity thereof calculated using an output pulse of the linear encoder 26. Further, the printer 11 includes a maintenance device 28 under a position of the carriage 14 where the carriage 14 is located at home position (one end position out of the printing area on the path of the carriage 14 moving (at the right end position in FIG. 1)). The maintenance device 28 performs cleaning or the like for preventing or solving nozzle blocking in the recording head 19. Under the platen 20 is installed a wasted ink tank 29 into which ink sucked by the maintenance device 28 from the nozzles of the recording head 19 is thrown away.

Figure 2:
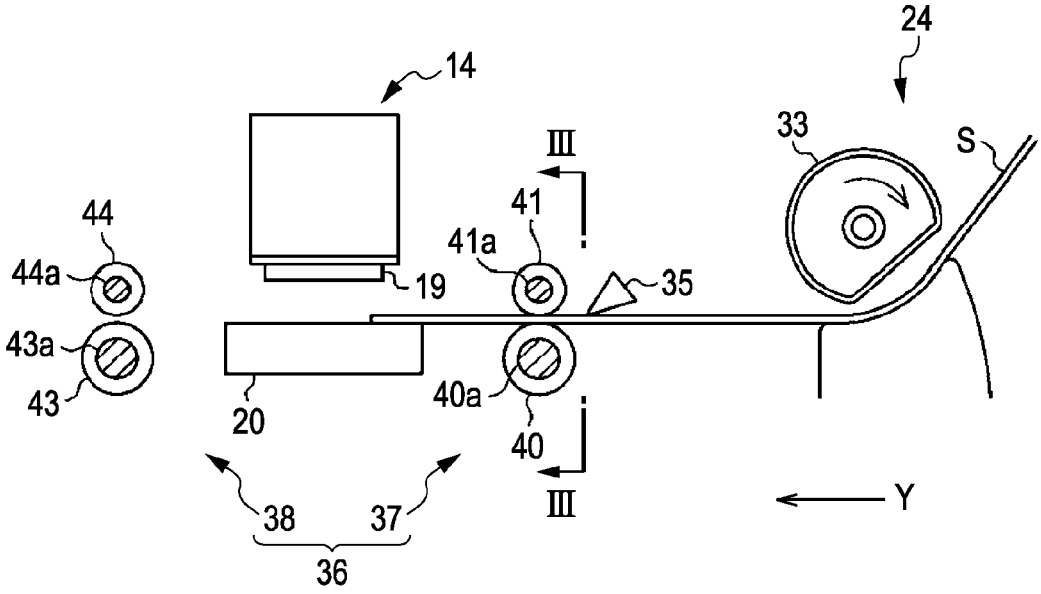
FIG. 2 is a schematic side view of a recording head and transport device.

As shown in FIG. 2, a sheet detecting sensor 35 is installed on the transport path of sheet S at the downstream side of the auto sheet feeder 24 in the transport direction (sub scanning direction Y). The sheet detecting sensor 35 is, for example, a contact type sensor (switch type sensor) that is turned on by the movement of a detecting lever contacting with the front end of the sheet S and turned off by the lever returning to the original position using spring forces thereof when the rear end of the sheet S passes through the lever. The sheet detecting sensor 35 may be a non-contact type sensor such as an optical sensor or the like as long as the sensor can detect the end of the sheet S.

As shown in FIG. 2, the transport device 36 includes sheet transport rollers 37 at the upstream side of the platen 20 in the transport direction (sub scanning direction Y) and sheet discharging rollers 38 at the downstream side of the platen 20 in the transport direction (sub scanning direction Y). In the embodiment, the sheet transport rollers 37 and the sheet discharging rollers 38 constitute a transport unit.

Figure 3:
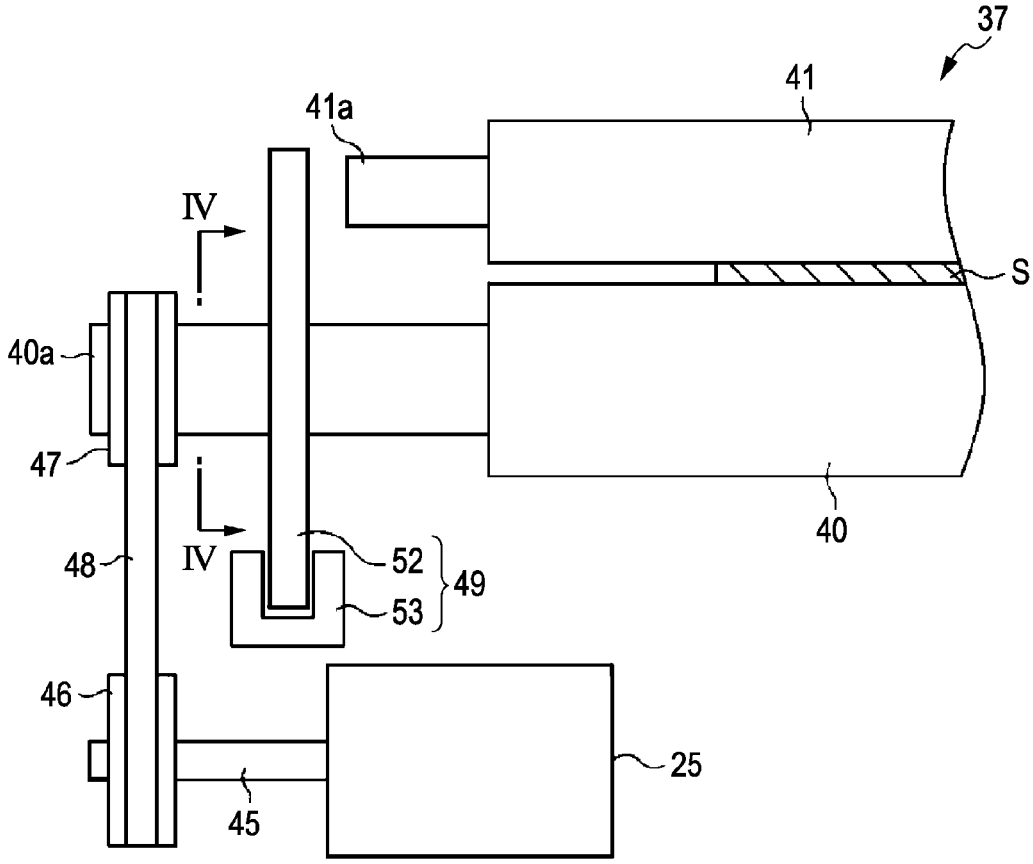
FIG. 3 is a cross-sectional view taken along a line 3-3 of FIG. 2.

As shown in FIGS. 2 and 3, the sheet transport roller 37 includes a first rotation shaft 40*a* rotated by the power of the PF motor 25 and a first driving roller 40 as a transport roller rotated by driving the first rotation shaft 40*a*. At the upper side of the first driving roller 40 is installed a first driven roller 41 that rotates about the center of a first driven shaft 41*a* by the rotation of the first driving roller 40. The first driven roller 41 is provided so as to be paired with the first driving roller 40.

The discharging roller 38 includes a second rotation shaft 43*a* rotated by the power of the PF motor 25 and a second driving roller 43 rotate by driving the second rotation shaft 43*a*. At the upper side of the second driving roller 43 is installed a second driven roller 44 that rotates about the center of a second driven shaft 44*a* by the rotation of the second driving roller 43. The second driven roller 44 is provided so as to be paired with the second driving roller 43.

The first and second rotation shafts 40*a*, 43*a* and the first and second driven shafts 41*a*, 44*a* are supported by bearings not shown.

As shown in FIG. 3, a driving pulley 46 is fixed to a driving shaft 45 of the PF motor 25 and integrally rotates therewith. A driven pulley 47 is fixed to the first rotation shaft 40*a* and integrally rotates therewith. A power transmission belt 48 of loop type is wound around the driving pulley 46 and driven pulley 47 so as to transmit the driving force of the PF motor 25 to the first driving roller 40.

Such configuration including the driving pulley 46, the driven pulley 47 and the power transmission belt 48 is also provided for the sheet discharging rollers 38. Accordingly, when the PF motor 25 is driven, the first driving roller 40 is rotated through the driving pulley 46, the driven pulley 47, and the power transmission belt 48 and further the second driving roller 43 is rotated through a driven pulley (not shown) which is provided to integrally rotate with the second rotation shaft 43*a*.

Figure 4:
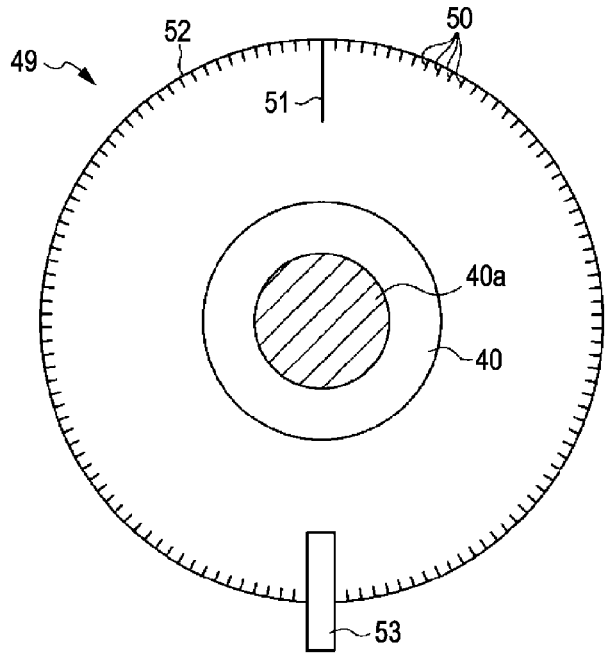
FIG. 4 is a cross-sectional view taken along a line 4-4 of FIG. 3.

As shown in FIGS. 3 and 4, a rotary encoder 49 is provided for the first rotation shaft 40*a*. The rotary encoder 49 is a phase detecter that outputs pulses the number of which is proportional to an amount of phase rotation of the first driving roller 40. The rotary encoder 49 includes a transparent circular plate encoder scale 52 in which a number of graduations 50 and one start point 51 are formed in the outer peripheral area thereof. The encoder scale 52 is provided to integrally rotate with the first rotation shaft 40*a*. Under the encoder scale 52 is installed a phase sensor 53 to face the peripheral area of the encoder scale 52. The phase sensor 53 detects passages of the graduations 50 and start point 51 accompanied by rotation of the encoder scale 52 and outputs pulses corresponding thereto.

That is, the rotary encoder 49 detects a phase start point (0 degrees) of the first driving roller 40 as follows. When the encoder scale 52 rotates so that the start point 51 is positioned at downside in FIG. 4, the phase sensor 53 detects the start point 51 as the phase start point. Further, a rotated phase from the phase start point of (0 degrees) can be detected on the basis of the number of pulses output after the passage of the start point.

That is, as shown in FIG. 4, when the first rotation shaft 40*a* rotates, the encoder scale 52 rotates and causes the start point 51 to arrive at the farthest upper position. The rotation phase at this time becomes 180 degrees.

Though the graduations 50 are schematically shown in the encoder scale 52 shown in FIG. 4, it is preferable to use the encoder scale 52 in which the graduations 50 are formed at regular intervals in the peripheral area to detect a transport distance of a sheet S in micrometers or the like.

Figure 5:
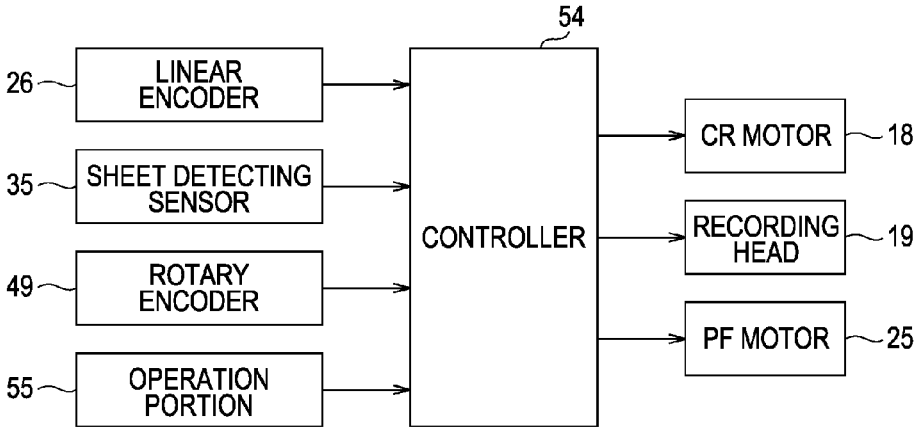
FIG. 5 is a block diagram illustrating a control configuration.

As shown in FIG. 5, the printer 11 includes a memory for controlling operations of the printer 11 and a controller 54 as a correcting unit. The controller 54 controls the CR motor 18, the recording head 19, and the PF motor 25 and performs printing or the like on the basis of detected results output from the linear encoder 26, the sheet detecting sensor 35, the rotary encoder 49 and user's operation on an operation portion 55.

Next, a method of forming a pattern P for measuring variations in the transport distance of a sheet S caused by an eccentricity or the like of the encoder scale 52 is described with reference to FIG. 6.

First, when the user operates the operation portion 55 to start measuring the variation, a variation measurement start signal is transmitted to the controller 54. Then, the controller 54 prints on the sheet S a plurality of patterns P for measurement based on a program for measurement stored in a ROM not shown. A method of forming a pattern P for measurement according to the embodiment is hereinafter described in which, for example, seven patterns P are formed at regular phase intervals (60 degrees) during one rotation of the first driving roller 40.

Specifically, the controller 54 rotates the sheet feeding roller 33, the first driving roller 40, and the second driving roller 43 by driving the PF motor 25. Then, the sheet S set on the sheet feeding tray 23 is fed to the transport device 36 by the sheet feeding roller 23 and transported by the sheet transport roller 37 onto the platen 20.

Subsequently, the controller 54 stops the PF motor 25 after the front end (downstream side in the transport direction) of the sheet S passes through the printing area facing the nozzles of the recording head 19 at a time when the encoder scale 52 detects the start point 51. That is, the first driving roller 40 stops in the condition that the rotation phase is 0 degrees.

Subsequently, the controller 54 moves the carriage 14 located at the home position to the left side in FIG. 6 by driving forward the CR motor 18. Upon the movement of the carriage 14 to the left side, the controller 54 continuously output to the recording head 19 an eject signal for ejecting black ink from the corresponding nozzles. Then, as shown in FIG. 6, the first pattern P1 for measurement in linear shape that extends in the main scanning direction X is formed on the sheet S.

When printing of the first pattern P1 for measurement is completed, the controller 54 drives the PF motor 25. Subsequently, the controller 54 stops driving the PF motor 25 so that the first driving roller 40 stops in the condition of the rotation phase being 60 degrees based on the detected result from the rotary encoder 49. Subsequently, the sheet S is transported by a distance D1 to the downstream side in the transport direction (sub scanning direction Y) which is indicated by the arrow.

The controller 54 moves the carriage 14 moved and stopped at the left side to the right side of the home position by driving inversely the CR motor 18. The controller 54 continuously outputs to the recording head 19 an eject signal for ejecting black ink from the same nozzles as that for forming the first pattern P1 for measurement. Then, the second pattern P2 for measurement in linear shape that extends in the main scanning direction X is formed on the sheet S at a position spaced the distance D1 from the first pattern P1 for measurement.

When printing of the second pattern P2 for measurement is completed, the controller 54 drives the PF motor 25 and further rotates the first driving roller 40 by 60 degrees. The controller 54 stops driving the PF motor 25 so that the first driving roller 40 stops in the condition of the rotation phase being 120 degrees based on the detected result from the rotary encoder 49. The sheet S is transported by a distance D2 to the downstream side in the transport direction (sub scanning direction Y) which is indicated by the arrow.

The controller 54 causes the third pattern P3 for measurement to be printed in the same condition as that for the first pattern P1 for measurement. Accordingly, the third pattern P3 for measurement is formed at a position spaced a distance D2 from the second pattern P2 for measurement, that is, at a position spaced a distance T2 (T2=D1+D2) from the first pattern P1 for measurement.

The controller 54 forms patterns P for measurement by ejecting black ink from the nozzles with rotating the first driving roller 40 by 60 degrees in the same manner.

That is, when the rotation phase is 180 degrees, the fourth pattern P4 for measurement is formed. Accordingly, the fourth pattern P4 for measurement is formed at a position spaced a distance D3 from the third pattern P3 for measurement, that is, at a position spaced a distance T3 (T3=T2+D3) from the first pattern P1 for measurement.

When the rotation phase is 240 degrees, the fifth pattern P5 for measurement is formed. Accordingly, the fifth pattern P5 for measurement is formed at a position spaced a distance D4 from the fourth pattern P4 for measurement, that is, at a position spaced a distance T4 (T4=T3+D4) from the first pattern P1 for measurement.

When the rotation phase is 300 degrees, the sixth pattern P6 for measurement is formed. Accordingly, the sixth pattern P6 for measurement is formed at a position spaced a distance D5 from the fifth pattern P5 for measurement, that is, at a position spaced a distance T5 (T5=T4+D5) from the first pattern P1 for measurement.

The controller 54 causes the patterns P for measurement to be continuously formed with the intermittent transport of the sheet S and movement of the carriage 14 to the right side and left side until the sheet detecting sensor 35 detects the rear end (upstream side in the transporting direction) of the sheet S.

Accordingly, a plurality of patterns P1 to Pm (m is a positive integer) respectively representing the first to m-th patterns are formed on the sheet S in the sub scanning direction Y. The patterns P1 to Pm are each spaced by Dn (n is a positive integer) and spaced away from the first pattern P1 for measurement by Tn respectively (in FIG. 6, a condition in which m=6 and n=5 is shown).

The distances D1 to Dn are transport distances of the sheet S in the sub scanning direction Y when the first driving roller 40 is rotated by the same rotation phase (60 degrees in the embodiment). Accordingly, if there is no eccentricity in the encoder scale 52 or the first driving roller 40, the transport distance becomes constant. However, if there is eccentricity therein, the transport distance varies continuously and periodically.

A method of calculating variations of the transport distance based on the patterns P for measurement printed on the sheet S is described. The variations of transport distance can be calculated in accordance with accumulation of difference (variation d) between a reference distance Di and each distance Dn calculated on the basis of a detection result of the rotary encoder 49.

The reference distance Di is an averaged distance of the distance of the sheet S transported by one rotation (360 degrees) of the first driving roller 40, which is obtained using a phase interval (60 degrees) between patterns P for measurement as a basis. Accordingly, in the embodiment, the distance of six times the reference distance Di corresponds to a distance of the sheet S transported by one rotation of the first driving roller 40.

Figure 7:
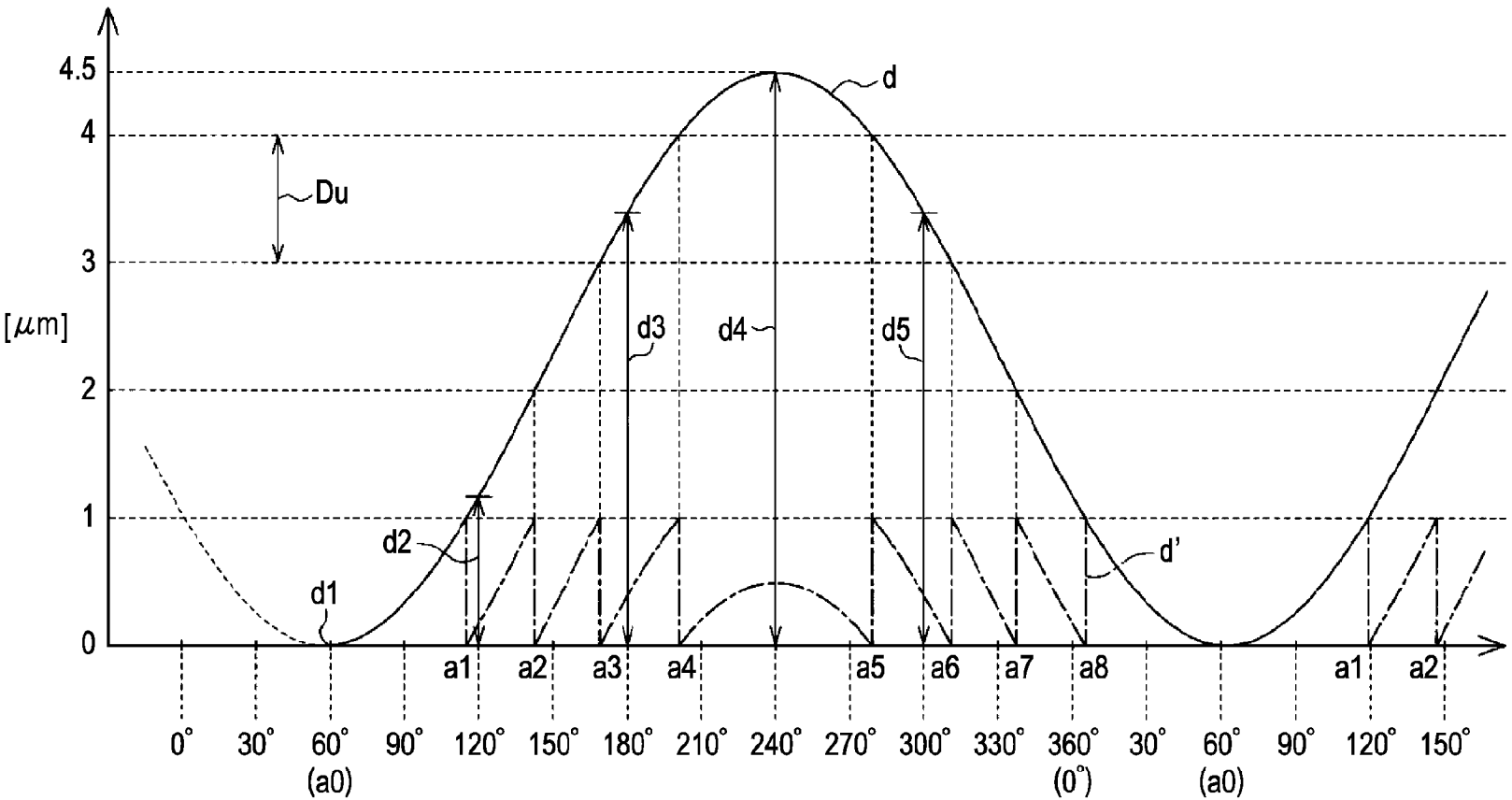
FIG. 7 is a graph showing a variation in a transport distance.

Specifically, the first pattern P1 for measurement printed on the sheet S is set to a reference, the distance D1 between the first pattern P1 for measurement and each pattern P for measurement, and distances T2 to Tn are measured. On the basis of the measured distances, a difference between the m-th pattern Pm and the reference distance n×Di is measured. Since a variation of the calculated variation d exhibits a curved shape, a graph represented by a solid line in FIG. 7 is estimated by selecting a phase of maximum variation. That is, a variation of transport distance caused by an eccentricity of the encoder scale 52 or the first driving roller 40 represents a continuous and periodic sine (cosine) curve and varies by 360 degrees as one cycle.

Figure 6:
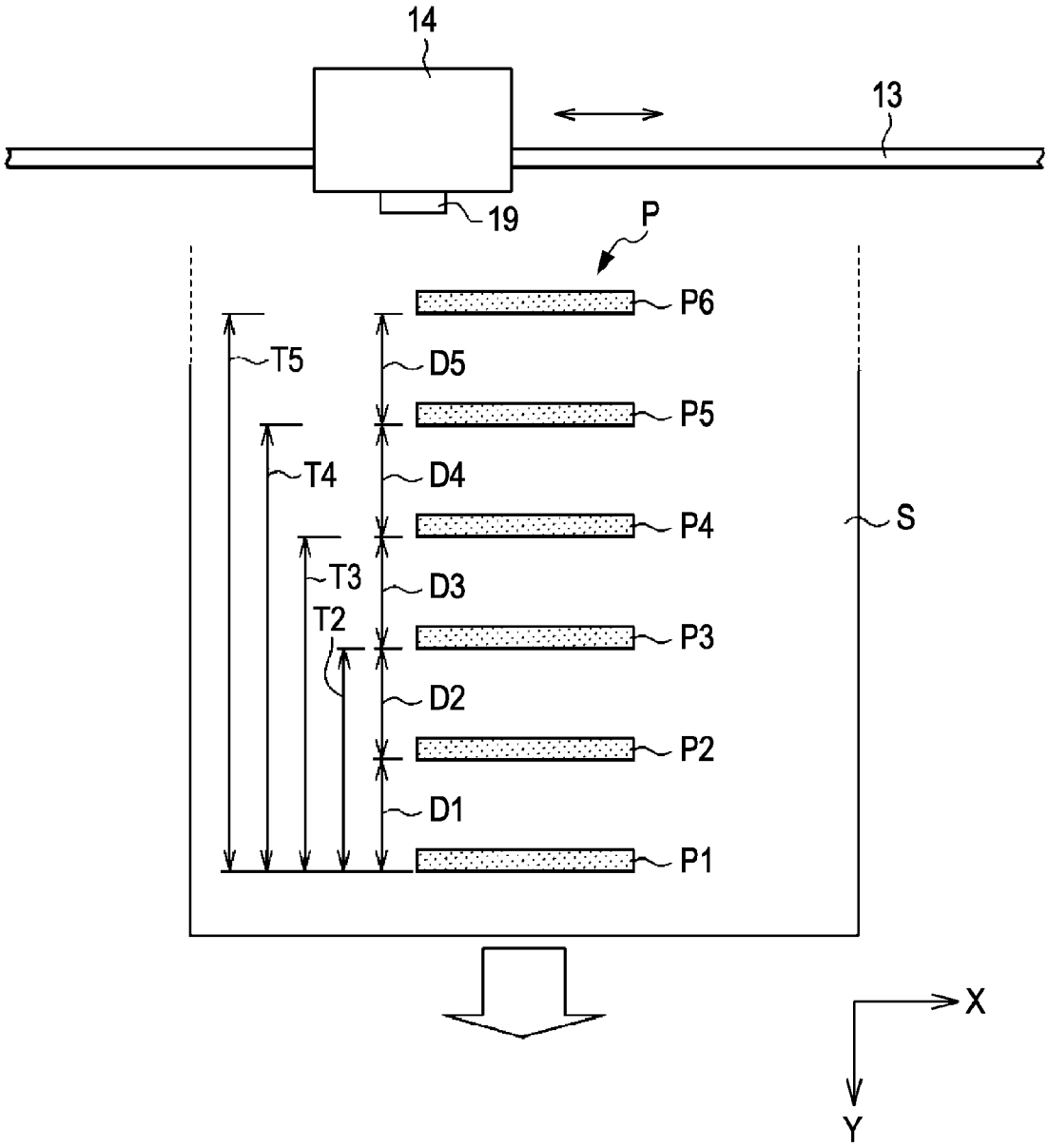
FIG. 6 is a diagram illustrating a process for providing a correction pattern.

Specifically, as shown in FIGS. 6 and 7, if variation d between the reference distance n×Di (nDi) and each pattern P for measurement is calculated, variation d is the first variation d1 (d1=D1−Di) for the second pattern P2.

In the same manner, the variation d is the second variation d2 (d2=T2−2Di) for the third pattern P3, the variation d is the third variation d3 (d3=T3−3Di) for the fourth pattern P4, the variation d is the fourth variation d4 (d4=T4−4Di) for the fifth pattern P5, and the variation d is the fifth variation d5 (d5=T5−5Di) for the sixth pattern P6.

Hereinafter, in the present embodiment, a method of calculating a correction phase is described. For example, it is assumed that the first variation d1≦the second variation d2≦the third variation d3=the fifth variation d5≦the fourth variation d4, and the fourth variation d4 at a rotation phase of 240 degrees is 4.5 times of the unit transport distance Du (for example 1 μm in the embodiment). Here, the unit transport distance Du is a distance of the sheet S transported by one pulse output from the rotary encoder 49.

As shown in FIG. 7, a rotation phase of 60 degrees where the variation d is zero is set as a reference phase a0. A phase when the variation d is multiple of the unit transport distance Du corresponding to one pulse that is a minimum unit detectable by the rotary encoder 49 is calculated as a correction phase. That is, for example, if the unit transport distance Du is 1 μm, a phase when the variation d is 1 μm, 2 μm, 3 μm, or 4 μm is calculated to be output.

Four correction phases a1 to a4 that are set during a half-cycle (180 degrees) rotation from the reference phase a0, and other correction phases a5 to a8 that are set during another half-cycle (180 degrees) rotation are stored in a nonvolatile memory (EEPROM) not shown of the controller 54.

That is, in the present embodiment, since the detectable minimum unit is one pulse output from the rotary encoder 49, the one pulse is set as a unit correction amount. In addition, the number of correction phases varies corresponding to a ratio of the maximum variation d to the unit transport distance Du. The number of correction phases of the half cycle is equal to a quotient (4) that is obtained by dividing the maximum variation d (4.5 μm, for example) by the unit transport distance Du (1 μm, for example).

When the sheet S is transported, the rotation is stopped at a position where one pulse is subtracted when passing through each of the correction phases a1 to a4 set in a range in which the variation increases. Meanwhile, the rotation is stopped at a position where one pulse is added to when passing through each of the correction phases a5 to a8 set in a range in which the variation decreases.

Accordingly, for example, if the first driving roller 40 is rotated by 30 degrees from a rotation phase of 60 degrees which is a reference phase of a0, there is no correction phase between the rotation phase of 60 degrees and a rotation phase of 90 degrees, the rotation is stopped at the rotation phase of 90 degrees.

Further, when the first driving roller 40 is rotated to 120 degrees of a rotation phase, since there is a correction phase a1, so the rotation is stopped at a phase which is reduced by one pulse from the rotation phase of 120 degrees. Further, when the first driving roller 40 is rotated to 150 degrees of a rotation phase which is 30 degrees added to the 120 degrees, since there is a correction phase a2, so the rotation is stopped at a phase which is reduced by two pulses from the rotation phase of 150 degrees by summing up the one pulse reduced in the rotation until 120 degrees and one pulse of correction caused by the rotation of this time.

In the same manner, when the first driving roller 40 is rotated to 180 degrees, since there is a correction phase a3, the rotation is stopped at a phase which is reduced by three pulses from the rotation phase of 180 degrees, and when rotated until 210 degrees, since there is a correction phase a4, the rotation is stopped at a phase which is reduced by four pulses from the rotation phase of 210 degrees.

Further, when the first driving roller 40 is rotated to 240 degrees and 270 degrees by additional rotation of 30 degrees respectively, since there is no correction phase, the rotation is stopped at a phase which is reduced by four pulses, being the maintained number of pulses, from the rotation phase of 240 degrees and 270 degrees, respectively.

When the first driving roller 40 is rotated to 300 degrees of the rotation phase, since there is a correction phase a5, the rotation is stopped at a phase which is reduced by three pulses from the rotation phase of the 300 degrees. The three pulses are obtained as the offset of the reduced four pulses and increased one pulse.

In the same manner, when the first driving roller 40 is rotated to 330 degrees and 360 degrees respectively, since there are correction phases a6 and a7 for the respective rotations, the rotation is stopped at a phase which is reduced by two pulses from the rotation phase of 330 degrees and a phase which is reduced by one pulse from the rotation phase of 360 degrees, respectively.

When the rotation phase reaches 360 degrees, since the phase sensor 53 detects the start point 51, the rotation phase is reset to zero degrees. In the meanwhile, the number of pulses increased or decreased is maintained after the rotation through the start point. When passing through the correction phase a8 through additional rotation of 30 degrees, the number of pulses becomes zero by the offset between the increased one pulse maintained from the previous rotation and the decreased one pulse. Accordingly, at the rotation phase of 30 degrees, the rotation is stopped without increase or decrease of the number of pulses. In addition, if the number of pulses increased or decreased is not zero at a time when the rotation passes the reference phase a0 owing to detected errors or the like, the number of pulses increased or decreased is set to zero.

Thus, as shown in FIG. 7, corrected variation d' becomes a smaller value than the unit transport distance Du corresponding to unit correction amount.

Printing on the sheet S by the printer 11 configured as described above is hereinafter described. The following description focuses on correction of sheet transport amount.

First, if a user operates the operation portion 55 to perform printing, the controller 54 drives the PF motor 25. Then, the sheet feeding roller 33 is rotated to feed the sheet S set on the sheet feeding tray 23, and the first driving roller 40 and the second driving roller 43 are controlled to rotate and stop so as to dispose the printing area of the sheet S on the platen 20. The rotation phase of the first driving roller 40 that is stopped is, for example, 90 degrees.

At this time, the first driving roller 40 stops after at least one rotation. That is, the start point 51 of the encoder scale 52 that rotates with the first driving roller 40 passes the phase sensor 53 at least one time. Accordingly, the controller 54 initializes the rotation phase based on an output result of the phase sensor 53 detecting the start point 51, and stores the rotation phase obtained by detecting output pulses corresponding to the scale 50 in a RAM not shown.

The controller 54 moves the carriage 14 in the main scanning direction by driving the CR motor 18 and causes the recording head 19 to eject ink for printing.

When the printing is completed, the controller 54 causes the PF motor 25 to transport the sheet S a distance that corresponds to the width of the printed area that is moved during the printing in the main scanning direction (a transport step).

According to the embodiment, the first driving roller 40 transports the sheet S by repeating the rotation and stopping of 240 degrees, for example. Accordingly, the controller 54 detects the rotation phase based on the number of pulses output from the rotary encoder 49 (detecting step), rotates the first driving roller 40 to 330 degrees and stops the roller. In this rotation, there are four correction phases a1 to a4 for which one pulse is reduced and two correction phases a5 and a6 to which one pulse is added. Accordingly, the controller 54 stops the first driving roller 40 at a position where two pulses are reduced from 330 degrees by offsetting added and reduced pulses (correction step).

The controller 54 controls the CR motor 18 and the recording head 19 to print in the main scanning direction X on a printing area that is continuous with the printed area of the sheet S in the sub scanning directionally Y.

Subsequently, the controller 54 transports the sheet S to the downstream side in the transport direction by driving the PF motor 25 to rotate the first driving roller 49 with additional 240 degrees (transporting step). That is, the rotation phase of the first driving roller 40 that is stopped at 330 degrees is detected on the basis of an output result from the rotary encoder 49 (detecting step), and the first driving roller 40 passes the reference phase a0 and stops at 210 degrees of the rotation phase. There are two phases, to which one pulse is added, before the rotation passes through the reference phase a0. However, the first driving roller 40 has been stopped at a phase that is reduced by two pulses from 330 degrees, the number of correction pulses is reset when the rotation passes through the reference phase a0. Accordingly, in this rotation, since there are four correction phases a1 to a4 from which one pulse is reduced, the first driving roller 40 is stopped at a position where four pulses are reduced from 220 degrees (correction step).

Printing and transporting are repeated in the same manner, and the sheet S on which the printing is completed is discharged by the discharging roller 38.

According to the above described embodiment, advantages described as follows are obtainable.

(1) The correction phases a1 to a8 for correcting the amount of rotation of the first driving roller 40 are stored in relation to the rotation phase of the first driving roller 40, and therefore the amount of rotation of the first driving roller 40 can be corrected at a suitable time. Further, the correction times are stored in advance as the phases of the first driving roller 40, causing a control load to be reduced. Accordingly, even though a variation of transport distance of the sheet S at each phase of the first driving roller 40 is small, the control load is reduced, a difference in correction time is suppressed and the transport distance of the sheet can be corrected.

(2) Since the correction amount for each correction phase is constant, the correction phase can be easily set on the basis of the actual transport distance of the sheet S during one rotation of the first driving roller 40. That is, the transport distance is continuously varied with the eccentricity or the like of the first driving roller 40. Therefore, the correction phase can be obtained by setting a phase that the variation d becomes the unit transport distance Du. The variation d is an accumulation of differences between the actual transport distance of the sheet S and an averaged transport distance calculated from the detected rotation phase. The amount of correction for each of the correction phases a1 to a8 of the first driving roller 40 need not to be stored, so that storage areas can be efficiently used.

(3) The correction is performed with the minimum unit (one pulse) detectable by the rotary encoder 49. Therefore, the variation of the transport distance of the sheet S is more reduced, and the sheet S can be transported more precisely.

(4) Recording can be performed on the sheet S where the variation of transport distance that varies continuously during one rotation of the first driving roller 40 as one cycle is reduced. Therefore, a shade of a printed matter caused by the variation of the transport distance is suppressed, and a printing quality can be improved.

The embodiment can be modified as follows. The above-described embodiment is applied to the transport device 36 transporting the sheet S in the printer 11 as a recording apparatus for printing on the sheet S. However, the invention can be applied to transport devices for transporting the sheet S in other apparatus.

In the above-described embodiment, the amount of correction for the transport of the sheet S is set as one pulse that is a minimum unit detectable by the rotary encoder 49. However, the number of pulses can be set as a unit correction amount.

In the above-described embodiment, the variation d of the sheet S is calculated by actually measuring the printed patterns P for measurement. However, the invention is not limited to the method as long as the variation d and the rotation phase of the rotary encoder 49 can be obtained.

In the above-described embodiment, the transport device 36 includes the sheet transport roller 37 at the upstream side of the platen 20 and the sheet discharging roller 30 at the downstream side of the same. However, the transport device 36 can include one of them. In addition, the sheet S can be transported by being positioned on a belt in loop shape which has a width larger than that of the sheet in the main scanning direction and is wound around the first driving roller 40 and the second driving roller 43.

In the above-described embodiment, the recording apparatus including the sheet transport device is the ink jet printer 11. However, the invention can be applied to liquid ejecting apparatuses ejecting or discharging liquid other than ink. The invention can be applied to liquid ejecting apparatuses including a liquid ejecting head discharging liquid droplets of very small amount. The liquid droplets represent a condition of the liquid discharged from the liquid ejecting apparatus, and include granular shape, tear shape, and thready shape liquid droplets. Any material of liquid can be used as long as the liquid ejecting apparatus can eject the material. For example, any material in liquid condition can be used. Liquid material of high or low viscosity, sol or gel water, other inorganic solvents, organic solvents, solutions, liquid resins, or style states of liquid metals (metal fluid) can be used. Further, in addition to a material in a state of liquid, particles of functional material made of pigments or metal particle molten, dispersed, or mixed in solvents are used. Representative examples of the liquid include ink described in the embodiment, liquid crystal or the like. The ink includes various liquid compositions such as general water ink, oil ink, gel ink, hot melt ink or the like. Examples of the liquid ejecting device include a liquid ejecting device ejecting liquid which is used for manufacturing a liquid crystal display, an electroluminescence display, a surface luminescence display, and a color filter and includes electrode materials or color materials in a dispersed or solved form, a liquid ejecting device ejecting vital organic materials used for biochips, a liquid ejecting device that is used as a precise pipette and ejects testing materials, a textile printing device, a micro dispenser or the like. Examples of the liquid ejecting device further include a liquid ejecting device ejecting lubricant to a precision instrument such as a watch or camera, a liquid ejecting device ejecting transparent resin liquid such as a liquid resin hardened by ultraviolet rays on a substrate to form a micro hemispheric lens (optical lens) used in optical communication devices, and a liquid ejecting device ejecting etching liquid such as acid, alkali or the like for etching a substrate or the like. The present invention can be applied to one of the liquid ejecting devices.

What is claimed is:

1. A sheet transport device, comprising:

a transporter that transports a sheet from an upstream side to a downstream side in a transport direction by a transport roller;

a driver that drives the transporter;

a phase sensor that detects a phase start point and a rotation phase indicating an amount of rotation from the phase start point of the transport roller that is rotated by driving of the driver;

a memory that stores correction phases for correcting transport distance of the sheet that is transported by rotation of the transport roller;

a corrector that performs correction control to reduce or increase the transport distance by a constant correction amount on the correction phase, and controls the performance of the correction control based on the rotation phase of the rotation.

2. The sheet transport device according to claim 1, wherein the constant correction amount is a minimum unit detectable by the phase sensor.

3. A recording apparatus, comprising:

the sheet transport device according to claim 1;

a recording unit that performs recording with a recording material adhering to the sheet transported by the sheet transport device.

* * * * *